US007411205B2

(12) United States Patent
Amarakoon et al.

(10) Patent No.: US 7,411,205 B2
(45) Date of Patent: Aug. 12, 2008

(54) IN-STACK SHEET THICKNESS MEASURING SYSTEM

(75) Inventors: Kiri B. Amarakoon, Pittsford, NY (US); Jodi F. Aboujaoude, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 642 days.

(21) Appl. No.: 11/072,782

(22) Filed: Mar. 4, 2005

(65) Prior Publication Data

US 2006/0208414 A1 Sep. 21, 2006

(51) Int. Cl.
*G01N 21/86* (2006.01)
*B65H 1/08* (2006.01)

(52) U.S. Cl. ..... 250/559.27; 250/559.36; 271/148

(58) Field of Classification Search ..... 250/559.4, 250/559.27, 559.24, 559.36; 347/19, 105; 356/431, 445–448; 271/97, 148
See application file for complete search history.

(56) References Cited

U.S. PATENT DOCUMENTS 5,673,907 A * 10/1997 Rumsey et al. ..... 271/9.13
7,267,337 B2 * 9/2007 Moore et al. ..... 271/148

* cited by examiner

*Primary Examiner*—Georgia Y. Epps
*Assistant Examiner*—Don Williams
(74) *Attorney, Agent, or Firm*—Fay Sharpe LLP

(57) ABSTRACT

A system and method of estimating the thickness of the individual sheets in a stack of sheets in a print media sheet input stacking tray before printing with an electronic sensing system for electronically detecting individual sheet edges in the stack thereof and a movement system providing a known traversal distance of the sheet edge sensing system relative to one side of the stack to produce multiple signals corresponding to multiple detected individual sheet edges, and dividing that multiplicity of signals into the known traversal movement to estimate the thickness of the individual print media sheets in the stack and provide a corresponding electrical output can be used for automatic control of sheet feeder, printer or finisher functions. A relatively simple contacting or non-contacting sensor may be used.

8 Claims, 4 Drawing Sheets

IN-STACK SHEET THICKNESS MEASURING SYSTEM

Disclosed in the embodiments herein is an improved system for estimating the thickness of sheets in a stack thereof. It may be used to estimate the thickness of print media sheets after they have been stacked for feeding but before the sheets are individually fed to be printed. A sheet thickness estimation in advance of printing may be used, for example, to control, adjust and/or optimize the operating parameters of the sheet separator/feeder for the particular stack of sheets, such as fluffer or air knife levels, or frictional normal forces, and/or printer operating parameters such as various current or voltages applied to components of a xerographic printer, such as transfer currents, fuser temperatures, etc. known to be desirably variable for different print media sheet thicknesses or related basis weights. And/or for control of printer output sheet finishers, such as folders, binders or booklet makers. Such adjustable feeder, printer or finisher components are well known per se and need not be described herein.

Also, a measurement of the thickness of the individual sheets in a stack can be combined with available information on the total stack height (such as from the extent of an elevator stacking tray movement down in loading the stack and/or movement up for feeding). That combined information can be used to provide an estimate of the number of sheets of paper initially loaded in the stack and/or the number of sheets remaining in the stack during feeding and printing to finish a print job, such as to avoid premature stoppage of printing to reload more paper.

Since typical print media sheets are very thin flimsy sheets, even for relatively heavy weight papers (varying in the range of only hundreds of microns) on-line measurement of their sheet thickness is difficult, especially to accuracies of, for example, only tens of microns. Most current printers do not have simple user-friendly adjustability for different sheet thicknesses, and may require printer operators to remember to manually enter data on the type of paper to be fed into a graphic user interface every time a different stack of paper is loaded into a paper tray.

One specific feature of the specific embodiments disclosed herein is to provide a printer with at least one print media sheet stacking tray into which stacks of different thickness print media sheets are loaded for printing, the improvement comprising a system for estimating the thickness of the individual print media sheets in said stack in said print media stacking tray before said sheets are fed to be printed, comprising an electronic sensing system for electronically detecting individual sheet edges in said stack thereof and providing an electrical signal thereof, and a movement system providing a known relative traversal movement distance of said electronic sensing system substantially orthogonal to one side of said stack to produce a multiplicity of said electrical signals corresponding to multiple said detected individual sheet edges, and a comparison circuit operatively connected to said electronic sensing system for dividing said multiplicity of electrical signals corresponding to said detected individual sheet edges into said known relative traversal movement distance of said electronic sensing system substantially orthogonal to one side of said stack to estimate said thickness of the individual print media sheets in said stack in said print media stacking tray.

Further specific features disclosed in the embodiments herein, individually or in combination, include those wherein said print media sheet stacking tray and said system for estimating the thickness of the individual print media sheets in said stack in said print media stacking tray are part of a print media input system of a xerographic printer in which said calculation of said thickness of the individual print media sheets in said stack in said print media stacking tray provides a control signal for operation of other components of said xerographic printer; and/or wherein said electronic sensing system comprises a non-contacting laser optical beam reflection detector; and/or wherein said electronic sensing system comprises a deflectable sheet edge contracting needle actuated sensor; and/or wherein said stack has a small skewed angle causing said individual sheet edges to form detectable individual steps; and/or wherein said stack has a small skewed angle of approximately 2 to 4 degrees causing said individual sheet edges to form detectable individual steps; and/or wherein said relative movement is at a substantially uniform velocity so that said electrical signals from said electronic sensing system corresponding to said detected individual sheet edges occur at regular intervals and irregular interval signals may be filtered out before said comparison circuit dividing; and/or wherein said known relative traversal movement is less than approximately 1 cm; and/or wherein said known relative traversal movement is provided by a small vertical movement of said print media sheet stacking tray relative to a stationary said electronic sensing system; and/or a method of estimating the thickness of the individual sheets in a stack of sheets comprising electronically detecting individual sheet edges in said stack thereof and providing an electrical signal thereof with a known relative traversal movement of an electronic sensing system substantially orthogonal to one side of said stack to produce a multiplicity of said electrical signals corresponding to multiple said detected individual sheet edges, and dividing said multiplicity of electrical signals corresponding to multiple detected individual sheet edges into said known relative traversal movement of said electronic sensing system substantially orthogonal to one side of said stack to calculate said thickness of the individual print media sheets in said stack in said print media stacking tray; and/or a method of estimating the thickness of the individual sheets in a stack of sheets in a print media sheet input stacking tray into which stacks of different thickness print media sheets are loaded for being fed to be printed, the improvement comprising a system for estimating the thickness of said individual print media sheets in said stack in said print media stacking tray before said sheets are fed to be printed, comprising an electronic sensing system electronically detecting individual sheet edges in said stack thereof and providing an electrical signal in response thereto, and a movement system providing a known relative traversal movement distance of said electronic sensing system substantially orthogonal to one side of said stack to produce a multiplicity of said electrical signals corresponding to multiple said detected individual sheet edges, and a comparison circuit operatively connected to said electronic sensing system dividing said multiplicity of electrical signals corresponding to said detected individual sheet edges into said known relative traversal movement distance of said electronic sensing system to estimate said thickness of said individual print media sheets in said stack in said print media stacking tray; and/or wherein said known relative traversal movement distance of said electronic sensing system substantially orthogonal to one side of said stack is between approximately 1 cm and the entire height of said one side of said stack; and/or wherein said print media sheet stacking tray and said system for estimating the thickness of the individual print media sheets in said stack in said print media stacking tray are part of a print media input system of a xerographic printer in which said calculation of said thickness of the individual print media sheets in said stack in said print media stacking tray provides a control signal for operation of other components of said xerographic printer; and/or wherein said electronic sensing system comprises a non-contacting laser optical beam reflection detector; and/or wherein said known relative traversal movement is provided by a small vertical movement of said print media sheet stacking tray relative to a stationary said electronic sensing system; and/or wherein said known relative traversal movement is provided by a small reciprocal movement of said print media sheet stacking tray relative to a stationary said electronic sensing system of less than approximately 1 cm.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed. A "copy sheet" may be abbreviated as a "copy" or called a "hardcopy." A "print job" is normally a set of related sheets, usually one or more collated copy sets copied from a set of original document sheets or electronic document page images, from a particular user, or otherwise related. The term sheet tray is used broadly herein to refer to any suitable sheet input stacking surface or module.

As to specific components of the subject apparatus or methods, or alternatives therefore, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the examples below, and the claims. This description of specific embodiments includes the drawing figures (which may be approximately to scale except as schematicized) wherein:

Figure 2:
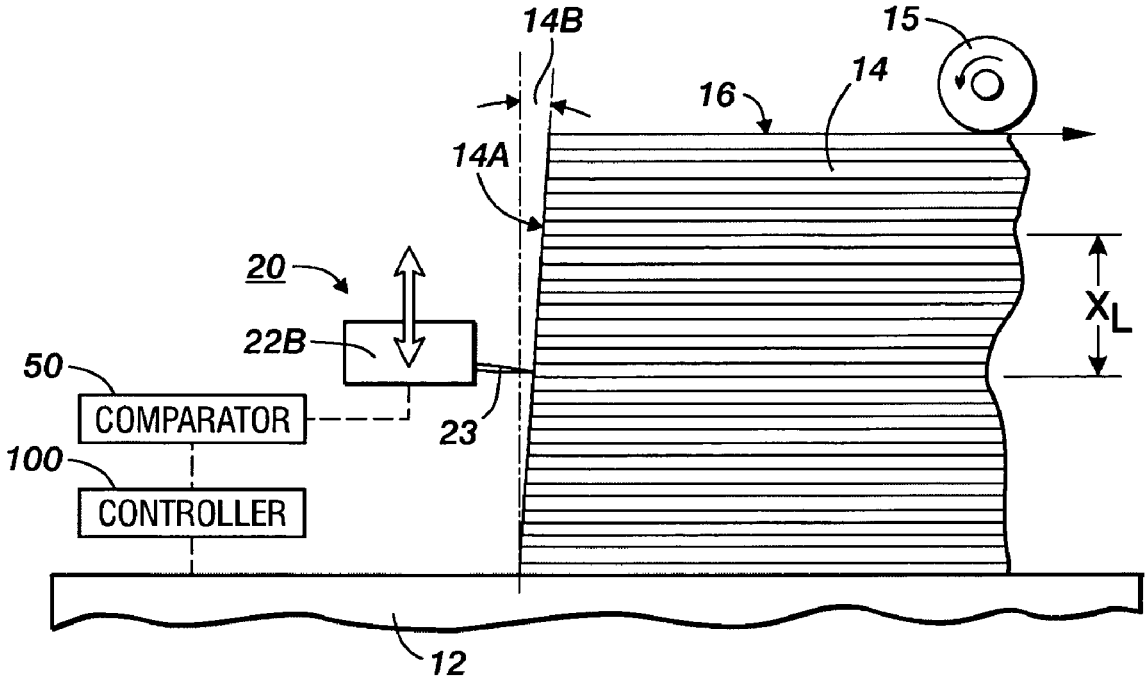
FIG. 2 is a partial enlarged view of the embodiment of FIG. 1.
Figure 3:
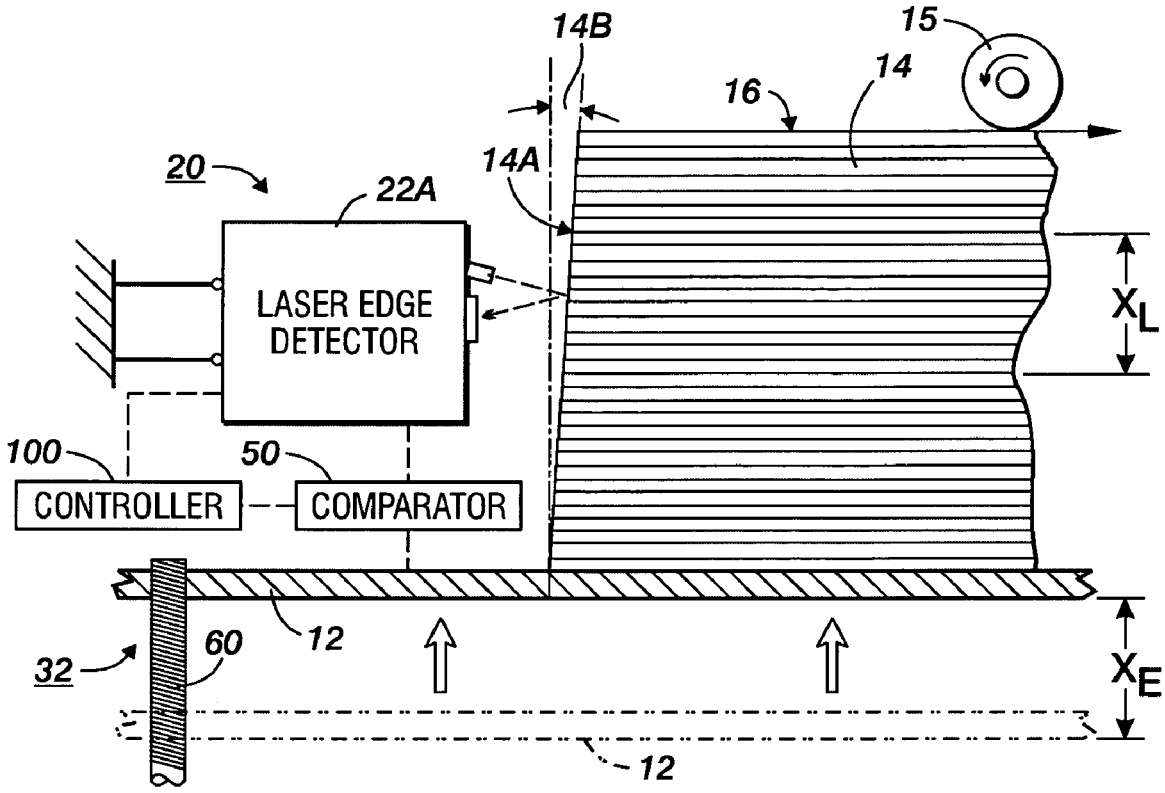
FIG. 3 is another embodiment of the in-stack sheet thickness estimating system of FIG. 1, using a non-contacting laser electronic sensor as the sheet edge detector.

Describing now in further detail these exemplary embodiments with reference to the Figures, there is shown an otherwise conventional reproduction machine such as a xerographic printer 10, with a sheet stacking tray 12 supporting a loaded stack 14 of individual print media sheets 16 for feeding the sheets 16 with a conventional sheet separator/feeder 15 to be printed in the printer 10. These are disclosed by way of examples of the applicability of the disclosed in-stack sheet thickness estimating (measuring) system 20 to various existing or future sheet feeders and printers. In FIG. 3 the sheet thickness measuring system 20 utilizes a non-contacting laser beam sheet edge optical detector 22A, and in FIGS. 1 and 2 it utilizes a contacting arm or needle 23 sheet edge optical detector 22B, either of which may be provided by commercially available components. In both examples the electrical signals or pulse train output of the sheet edge detectors 22A or 22B may be connected to simple comparator (comparison circuits) and printer controllers 100.

Figure 1:
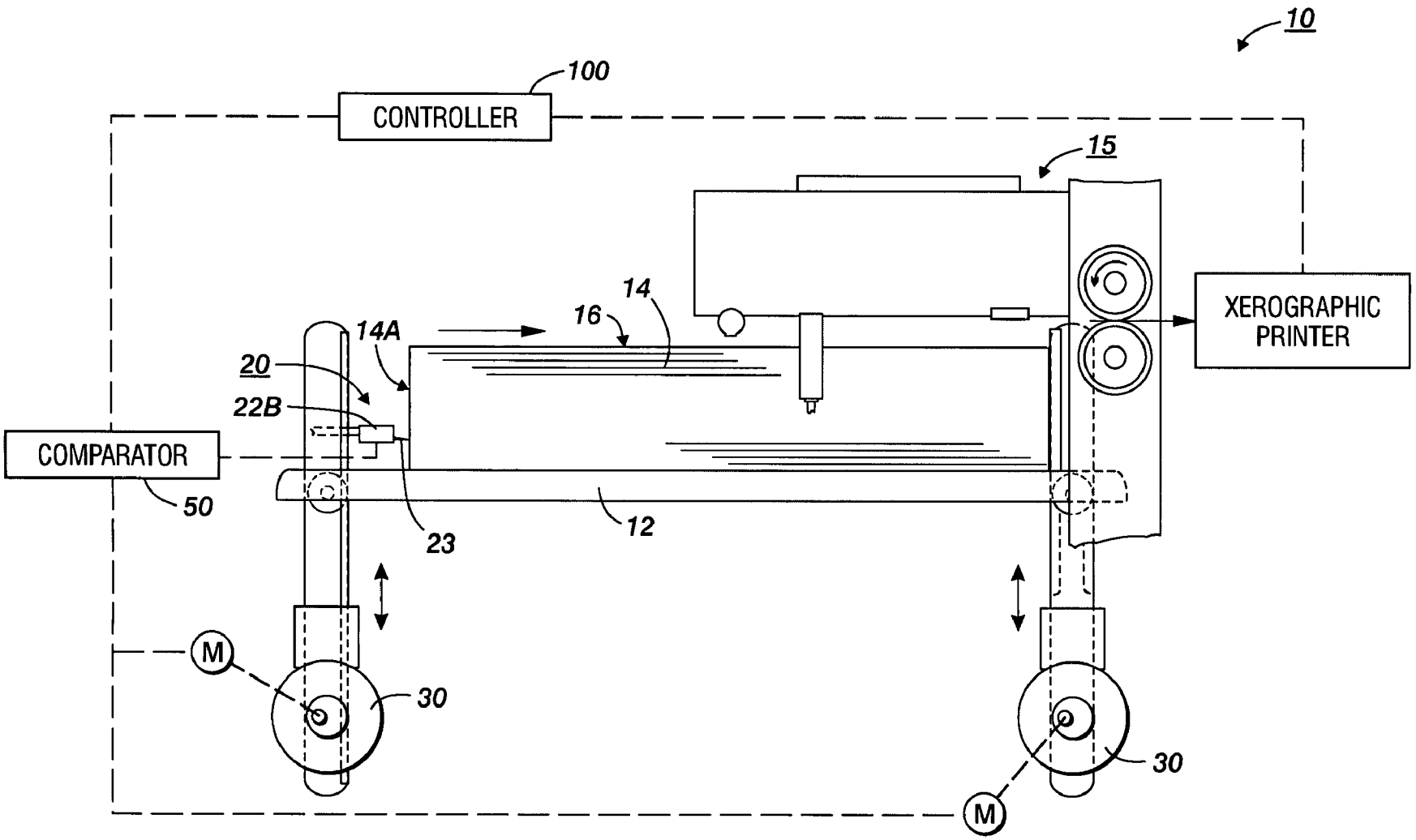
FIG. 1 is a plan view one example of an in-stack sheet thickness estimating system in the input sheet stacking elevator tray of a xerographic printer (with otherwise conventional elements schematicized)
Figure 4:
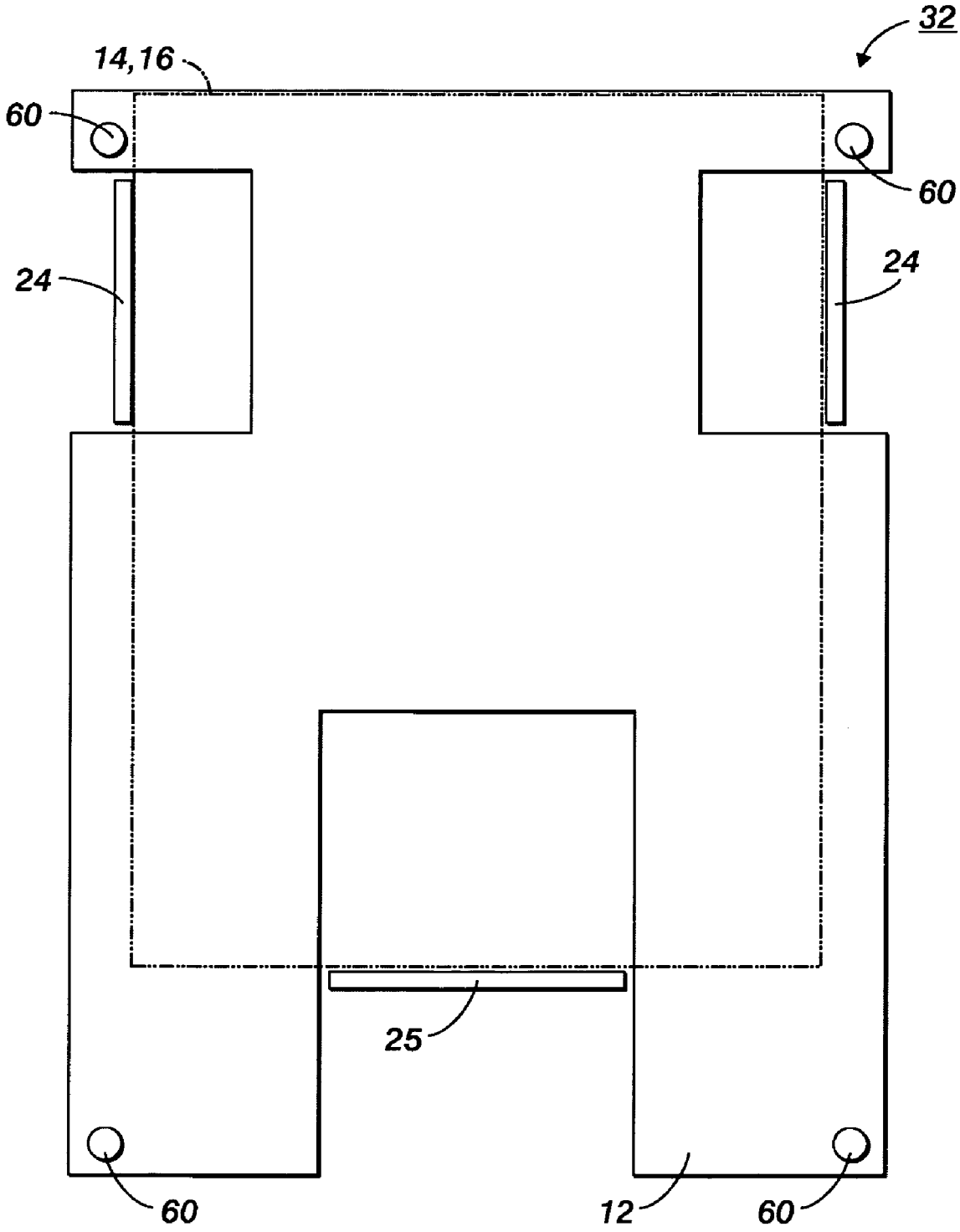
FIG. 4 is a top view of the exemplary input sheet stacking elevator tray of FIG. 3.

In the example of FIG. 1 the sheet stacking tray 12 may be raised or lowered by a tray elevator stack movement system 30 driven by servo or stepper motors M, which may be controlled by the controller 100. In the example of FIG. 2 the sheet stacking tray 12 is stationary and the contacting sheet edge optical detector 22B is moved up or down relative to a stationary stack 14 by any suitable movement system which can also track the movement distance, such as a servo or stepper motor. In FIGS. 3 and 4 the sheet stacking tray 12 may be raised or lowered by another conventional tray elevator stack movement system 32 driven by a similar or suitable drive system commonly rotating lead screws 60 which may be controlled by the controller 100. As shown in FIG. 4 the sheet stacking tray 12 may also have adjustable side and end guides or edges 24 and 25 resetable for the different size sheets 16 being stacked thereon.

The exemplary embodiments utilize either a contacting or non-contacting paper edges counting device for a given height of paper stack. The former may be accomplished by a simple scanning head 22B based on an audio phonographic cartridge, such as the existing transducers used in low cost audio devices such as moving coil or ceramic phonograph cartridges. The latter sensor, 22A, may be based on a laser derived small spot scanner, such as one similar to a laser reading head from a player for audio CDs or CD ROMs or perhaps a version of one of the optical sheet edge detectors used in the paper path of xerographic printers. The non-contacting laser may rides on a shoe track or other guide so as to keep the laser to paper stack distance constant to maintain focus. The resolution achievable from such devices is believed to be possible in the region of tens of microns, and thus suitable for estimating the thickness of paper in the region of hundreds of microns. The needle 23 or the laser spot is scanned on the edge 14A of the paper stack 14, which may be slightly skewed as show by 14B in FIG. 2. This stacking skew, if used, need not be large, for example only approximately 2 to 4 degrees, and need not be for the entire stack, for example only over a known stack edge scanning distance $X_L$ of approximately 10 mm. The resultant signal from the sensor 22A or 22B scanner is processed to count the number of spikes detected at the paper 16 edge interfaces over the vertical scan distance $X_L$ along the stack edge 14A. The total number of sheet edge spike counts in this scan divided by this scanning distance $X_L$ in comparator 50 or elsewhere yields the thickness of the individual sheets 16. Filtering or other known electronic corrections can be made by ignoring or filling in for bad or missing spikes, averaging the good spikes, and filtering for the valid spike frequency, which will be substantially uniform with a substantially uniform scanning rate provided by a substantially uniform elevator tray movement ($X_E$, equal to $X_L$, FIG. 3) or a comparable scanner movement $X_L$ as in FIG. 2.

Referring further to the disclosed optional feature where the paper stack is made to sit in the paper tray at a very slight angle of around 2 to 4 degrees, such as by slightly angled stack end or side guides. This will make the edge of the stack look like a staircase of small steps or peaks and valleys as seen by the sensor transducer, which is mounted adjacent to a side or end of the skewed stack so that it can read these peaks and valleys by gently traversing the edge of the stack for a given distance by relative movement between the stack and the transducer. As shown, this can be achieved either by moving the transducer or by elevating the paper tray. The stack edge distance scanned can be as little as one or two cm, to insure that a sufficiently large number of sheet edges are scanned to provide averaging accuracy for the number of pulses that the transducer emits for a given scanning distance to calculate the thickness of a sheet. There will be counting errors and signal noises. However, since the maximum range of paper thicknesses will be known, and most of the pulses will have a common frequency or clock rate, discarding inconsistent error pulses or noise can be done with known intelligent signal processing, such as that variously used in digital communications, to detect and correct errors and thus, with the averaging provided over a large number of pulses, determine the paper thickness to a fairly high degree of accuracy. The sheet thickness measurement can desirably be a corresponding electrical signal level or encoded output, which may be displayed or used as an electrical control signal providing for automatic control of the stack sheet feeder, printer and/or finisher functions.

As noted in the introduction, the sheet thickness information signals obtained by the disclosed system and method can be used to provide an estimate of the number of sheets of paper initially loaded in the stack and/or the number of sheets remaining in the stack during feeding and printing to finish a print job, such as to avoid premature stoppage of printing to reload more paper. In scanning the stack it may be desirable to start near the top of the stack and scan down by the selected scan distance. Since the tray elevator position relative to the sheet feed head is known from the tray elevator motor encoders, knowing the sheet thickness predicts the number of sheets in the stack without needing to scan the entire stack to count all the sheet edges. If the operator may have loaded different thickness sheets on top of a stack of previous sheets, that thickness information will be valid for feeding those sheets, but may not be valid for estimating the total number of sheet in the stack. However, the total number of sheets stacked in the tray at a given time could also be calculated by scanning the entire stack if the stack has or is suspected of having a mixture of different sheet thicknesses.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method for determining a thickness of individual print media sheets in a stack of sheets in a print media sheet stacking tray, said method comprising:

providing a stationary sheet edge electronic sensing system for detecting individual sheet edges in said stack, providing a known relative traversal movement distance of said sheet edge sensing system to one side of said stack said sensing system enabled to produce multiple signals corresponding to multiple detected individual sheet edges and dividing said multiple signals into said known traversal movement distance to provide the thickness of said individual print media sheets in said stack; and wherein said known relative traversal movement distance is provided by vertical movement of said print media sheet stacking tray relative to said stationary electronic sensing system and wherein a calculation of said thickness of said individual print media sheets provides a control signal for operation of other components of a Xerographic marking system.

2. The method of claim 1 wherein said known relative traversal movement distance is less than about 1 cm.

3. The method of claim 1 wherein said stack has a skewed angle of from 2 to 4 degrees causing said individual sheet edges to form detectable individual steps.

4. The method of claim 1 wherein said electronic sensing system comprises a deflectable sheet edge contacting needle actuated sensor.

5. A sheet stacking tray useful in a printer comprising:

a stationary electronic sensing system for electronically detecting individual sheet edges in a sheet stack and enabled to provide an electrical signal thereof, and a relative movement system enabled to provide a known relative traversal movement distance of said electronic sensing system substantially orthogonal to one side of said stack enabled to produce a multiplicity of said electrical signals corresponding to multiple said detected individual sheet edges, and a comparison circuit operatively connected to said stationary electronic sensing system for dividing said multiplicity of electrical signals corresponding to said detected individual sheet edges into said known relative transversal movement distance of said electronic sensing system substantially orthogonal to one side of said stack and enabled to estimate said thickness of the individual print media sheets in said stack in said print media stacking tray, and wherein said relative movement is at a substantially uniform velocity so that said electrical signals from said stationary electronic sensing system corresponding to said detected individual sheet edges occur at regular intervals and irregular interval signals are enabled to be filtered out before said comparison circuit dividing.

6. The sheet stacking tray of claim 5 wherein said print media sheet stacking tray and said system for estimating the thickness of the individual print media sheets in said stack in said print media stacking tray are part of a print media input system of a xerographic printer in which said calculation of said thickness of the individual print media sheets in said stack in said print media stacking tray provides a control signal for operation of other components of said xerographic printer.

7. The sheet stacking tray of claim 5 wherein said stationary electronic sensing system comprises a non-contacting laser optical beam reflection detector.

8. The sheet stacking tray of claim 5 wherein said stationary electronic sensing system comprises a deflectable sheet edge contracting needle actuated sensor.

* * * * *